US006616829B2

(12) United States Patent
Keller et al.

(10) Patent No.: US 6,616,829 B2
(45) Date of Patent: Sep. 9, 2003

(54) CARBONACEOUS CATHODE WITH ENHANCED WETTABILITY FOR ALUMINUM PRODUCTION

(75) Inventors: Rudolf Keller, Export, PA (US); David G. Gatty, Leechburg, PA (US); Brian J. Barca, Munhall, PA (US)

(73) Assignee: EMEC Consultants

( * ) Notice: Subject to any disclaimer, the term of this patent is extended or adjusted under 35 U.S.C. 154(b) by 0 days.

(21) Appl. No.: 09/834,190

(22) Filed: Apr. 13, 2001

(65) Prior Publication Data

US 2002/0148735 A1 Oct. 17, 2002

(51) Int. Cl.[7] ..... C25C 3/08; C25C 3/12; C22C 32/00; C01F 1/00

(52) U.S. Cl. ..... 205/386; 205/387; 423/111; 419/12

(58) Field of Search ..... 205/372, 386, 205/387; 419/12; 423/111

(56) References Cited

U.S. PATENT DOCUMENTS

| | | | | |
|---|---|---|---|---|
| 3,028,324 A | | 4/1962 | Ransley | 204/67 |
| 3,400,061 A | | 9/1968 | Lewis et al. | 204/67 |
| 3,471,380 A | | 10/1969 | Bullough | 204/67 |
| 3,560,448 A | | 2/1971 | Lodge | 260/78 |
| 3,616,045 A | * | 10/1971 | Kozar et al. | 156/326 |
| 4,093,524 A | | 6/1978 | Payne | 204/61 |
| 4,097,567 A | | 6/1978 | Cebulak et al. | 264/65 |
| 4,308,114 A | | 12/1981 | Das et al. | 204/67 |
| 4,308,115 A | | 12/1981 | Foster et al. | 204/67 |
| 4,333,813 A | | 6/1982 | Kaplan et al. | 204/243 |
| 4,341,611 A | | 7/1982 | Kaplan | 204/243 |
| 4,396,482 A | | 8/1983 | Das et al. | 204/243 |
| 4,411,758 A | | 10/1983 | Hess et al. | 204/243 |
| 4,466,692 A | | 8/1984 | Sonoda | 339/276 |
| 4,466,995 A | | 8/1984 | Boxall et al. | 422/113 |
| 4,466,996 A | | 8/1984 | Boxall et al. | 427/122 |
| 4,526,911 A | | 7/1985 | Boxall et al. | 523/445 |
| 4,544,469 A | | 10/1985 | Boxall et al. | 204/243 |

(List continued on next page.)

FOREIGN PATENT DOCUMENTS

| | | |
|---|---|---|
| EP | 0021850 | 1/1981 |
| NO | 175159 | 5/1994 |
| WO | 0029644 | 5/2000 |
| WO | 0036187 | 6/2000 |

OTHER PUBLICATIONS

Kellner, J. D. et al, "Titanium Diboride Electrodeposited Coatings," Army Materials and Mechanics Research Center, Watertown, Massachusetts 02172, AMMRC TR 77–17, Jun. 2577, pp. 1–2, 31–32. (No Date).

Sørlie, M. et al, "Cathodes in Aluminium Electrolysis", 2nd Ed., Aluminium–Verlag, 1994, pp. 66–73 and 404–405. (No Month).

(List continued on next page.)

*Primary Examiner*—Donald R. Valentine
(74) *Attorney, Agent, or Firm*—Andrew Alexander

(57) ABSTRACT

A method of preparing carbonaceous blocks or bodies for use in a cathode in an electrolytic cell for producing aluminum wherein the cell contains an electrolyte and has molten aluminum contacting the cathode, the cathode having improved wettability with molten aluminum. The method comprises the steps of providing a carbonaceous block and a boron oxide containing melt. The carbonaceous block is immersed in the melt and pressure is applied to the melt to impregnate the melt into pores in the block. Thereafter, the carbonaceous block is withdrawn from the melt, the block having boron oxide containing melt intruded into pores therein, the boron oxide capable of reacting with a source of titanium or zirconium or like metal to form titanium or zirconium diboride during heatup or operation of said cell.

35 Claims, 2 Drawing Sheets

U.S. PATENT DOCUMENTS

| | | | | | |
|---|---|---|---|---|---|
| 4,560,448 | A | | 12/1985 | Sane et al. | 204/67 |
| 4,576,651 | A | | 3/1986 | Deutschman | 134/25.1 |
| 4,624,766 | A | | 11/1986 | Boxall et al. | 204/294 |
| 4,763,585 | A | | 8/1988 | Rickman et al. | 110/346 |
| 4,927,459 | A | | 5/1990 | Gardner et al. | 75/685 |
| 4,973,464 | A | | 11/1990 | Rickman | 423/461 |
| 4,993,323 | A | | 2/1991 | Tabery et al. | 110/346 |
| 5,024,822 | A | | 6/1991 | Hittner et al. | 423/111 |
| 5,028,301 | A | | 7/1991 | Townsend | 204/39 |
| 5,160,698 | A | * | 11/1992 | Khazai et al. | 419/12 |
| 5,222,448 | A | | 6/1993 | Morgenthaler et al. | 110/346 |
| 5,314,599 | A | | 5/1994 | Allaire | 204/473 |
| 5,449,529 | A | * | 9/1995 | Okada et al. | 427/228 |
| 5,538,604 | A | | 7/1996 | Keller et al. | 204/473 |
| 5,683,663 | A | | 11/1997 | Keller et al. | 423/111 |
| 5,961,811 | A | | 10/1999 | Keller | 205/386 |

OTHER PUBLICATIONS

Wendt, H. et al, "Cathodic deposition of refractory intermetallic compounds from FLINAK melts—I. Voltammetric Investigation of Ti, Zr, B, $TiB_2$ and $ZrB_2$", Electrochimica Acta. vol. 37, No. 2, pp. 237–244, 1992. (No Month).

Wendt, H. et al, "Cathodic deposition of reftactory intermetallic compounds from FLINAK melts. Part II: Preparative Cathodic deposition of $TiB_2$ and $ZrB_2$ and coatings thereof", Journal of Applied Electrochemistry 22 (1992), pp. 161–165. (No Month).

* cited by examiner

CARBONACEOUS CATHODE WITH ENHANCED WETTABILITY FOR ALUMINUM PRODUCTION

This invention was made with Government support under Contract No. DE-FG07-98ID13664 awarded by the Department of Energy. The Government has certain rights in this invention

BACKGROUND OF THE INVENTION

This invention relates to production of aluminum, and more particularly it relates to a treatment for carbonaceous members such as carbon blocks and carbon cathodes for use in the production of aluminum to improve performance of the cell.

In U.S. Pat. No. 5,961,811, there is described the Hall-Heroult process for making primary aluminum from aluminum oxide dissolved in a molten salt such as cryolite. In that patent, electrolysis is used to form molten aluminum at the cathode. The electrolysis is carried out at a temperature in the range of about 930 to 980° C. The molten salt is contained in a steel shell which is lined with refractories and carbonaceous material. The lining containing the cathode metal, located in the bottom of the cell, is usually made of carbon materials. In addition, refractories are used to maintain thermal conditions in the cell. The amount of carbon used is substantial. For example, a Hall-Heroult cell of moderate size uses about 24,000 pounds of carbon block for lining purposes and uses about 10,000 pounds of carbon ramming paste to complete the lining and to hold the carbon blocks in place. The cell has to be relined about every 4 to 6 years, producing large quantities of used carbonaceous material and refractories, i.e., spent potlining.

As noted in U.S. Pat. No. 5,961,811, the use of carbonaceous cathodes is not without problems. For example, they are not readily wettable with molten aluminum. Thus, conductivity through the surface of the cathode is not uniform but tends to be intermittent. Also, the carbon cathode surface reacts with the molten aluminum to form aluminum carbide which depletes the cathode at a rate of 2 to 5 cms per year for an operating electrolytic cell. This depletion is fostered by the presence of sludge containing fluoride bath components at the interface between cathode carbon and metal. The aluminum carbide also is detrimental because it results in a high electrical resistivity material which interferes with the efficiency of the cell.

The carbon cathodes have another problem. The presence of sodium results in the formation of sodium cyanide in the carbon bodies causing disposal problems with the spent potlinings. The Environmental Protection Agency has listed spent potlinings as a hazardous material because they contain cyanides. Thus, it will be seen that there is a great need for a carbonaceous cathode that is wettable with molten aluminum and is resistant to formation of cyanide.

In U.S. Pat. No. 5,961,811, there is disclosed an improved carbonaceous material suitable for use as a cathode in an aluminum producing electrolytic cell, the cell using an electrolyte comprised of sodium containing compounds. The carbonaceous material is comprised of carbon and a reactive compound capable of suppressing the formation or accumulation of sodium cyanide during operation of the cell, and of reacting with one of titanium or zirconium to form titanium or zirconium diboride during operation of the cell to produce aluminum.

In attempts to provide aluminum wettable surfaces on carbon cathodes, application of titanium boride or zirconium boride has been suggested. These materials have been used as tiles to cover the cathode surface and are described in U.S. Pat. Nos. 3,400,061; 4,093,524; 4,333,813; and 4,341,611. However, these approaches have not been without problem. That is, the tiles and coatings tend to fall off after a short period of use, and this interferes with continued use of the cell. Also, coatings of titanium diboride have been applied in cement to the carbonaceous surface in U.S. Pat. Nos. 4,544,469; 4,466,692; 4,466,995; 4,466,996; 4,526,911; 4,544,469 and 4,624,766. EPO 0 021 850 suggests electroplating titanium diboride onto the carbon surface. U.S. Pat. No. 5,028,301 suggests deposition of a coating composed of titanium diboride and titanium carbide on cathode parts from supersaturated dissolved elements in electrowon aluminum. In a book entitled "Cathodes in Aluminum Electrolysis", 2nd edition, published 1994 by Aluminium-Verlag and authored by M. Sørlie and H. A. Øye limited durability and cost of the material are cited as obstacles to effective industrial use.

Patent application (PCT) WO 00/29644 discloses wettable and erosion/oxidation resistant carbon composite materials. The materials are formed by mixing together finely divided quantities of $TiO_2$ and $B_2O_3$ (or other metal boride precursors) to produce a precursor or mixture which is then mixed with at least one carbon-containing component to produce a carbon composite material that forms $TiB_2$ (or other metal boride) in-situ when exposed to molten aluminum or subjected to heat-up of the cell. The invention also relates to carbon composite materials thus produced that may be used to form blocks (including sidewall blocks) for the construction of cathode structures (or coatings for such blocks) or may be used to prepare joint-filling and coating compositions for use in aluminum reduction cells, or protective coatings for instruments used with molten metals. However, when reactive materials are incorporated and mixed with the carbonaceous material, the resulting cathode block has compromised properties. For example, electrical conductivity is reduced or the block exhibits a greater electrical resistance detrimentally affecting the efficiency of the cell.

It will be seen that there is a great need for a method that permits the use of carbonaceous materials such as carbonaceous cathodes and blocks which is effective in promoting wetting with molten aluminum and is effective in preventing formation of undesirable compounds such as cyanide compounds during use of the cell to produce aluminum. Promoting wetting of the cathode greatly increases the efficiency of the cell. Preventing or reducing formation of compounds such as cyanide compounds minimizes post-treatment for the spent carbonaceous materials.

SUMMARY OF THE INVENTION

It is an object of the invention to provide an improved carbonaceous cathode for use in an aluminum producing electrolytic cell.

It is another object of the invention to provide a treatment for a carbonaceous cathode for an aluminum producing electrolytic cell, the treatment resulting in the cathode having improved molten aluminum wetting characteristics, leading to lower cell resistance, lower tendency to accumulation of sludge and decreased wear of the cathode surface.

Still, it is another object of the invention to provide a process for treating a carbonaceous cathode for use in an aluminum producing electrolytic cell, the treated cathode capable of reacting with a source of titanium or zirconium or like metal to form a metal boride on the cathode surface to promote improved wetting of the cathode with molten aluminum.

Further, it is another object of the invention to suppress or minimize air oxidation or air burning of cathode blocks during cell start-up and of exposed carbonaceous sidewalls in an electrolytic cell for producing aluminum.

These and other objects will become apparent from reading the specification and claims appended hereto.

In accordance with these objects there is provided a method of preparing carbonaceous blocks or bodies for use as a cathode in an electrolytic cell for producing aluminum wherein the cell contains an electrolyte and has molten aluminum contacting the cathode, the cathode having improved wettability with molten aluminum. The method comprises the steps of providing a carbonaceous block and a boron oxide containing melt. The carbonaceous block is immersed in the melt and pressure is applied to the melt to impregnate the melt into pores of the carbonaceous block. Thereafter, the carbonaceous block having boron oxide containing melt intruded into the pores is withdrawn from the melt, the boron oxide capable of reacting with a source of titanium or zirconium or like metal to form titanium or zirconium diboride during heatup or operation of said cell.

DETAILED DESCRIPTION OF THE PREFERRED EMBODIMENTS

Figure 1:
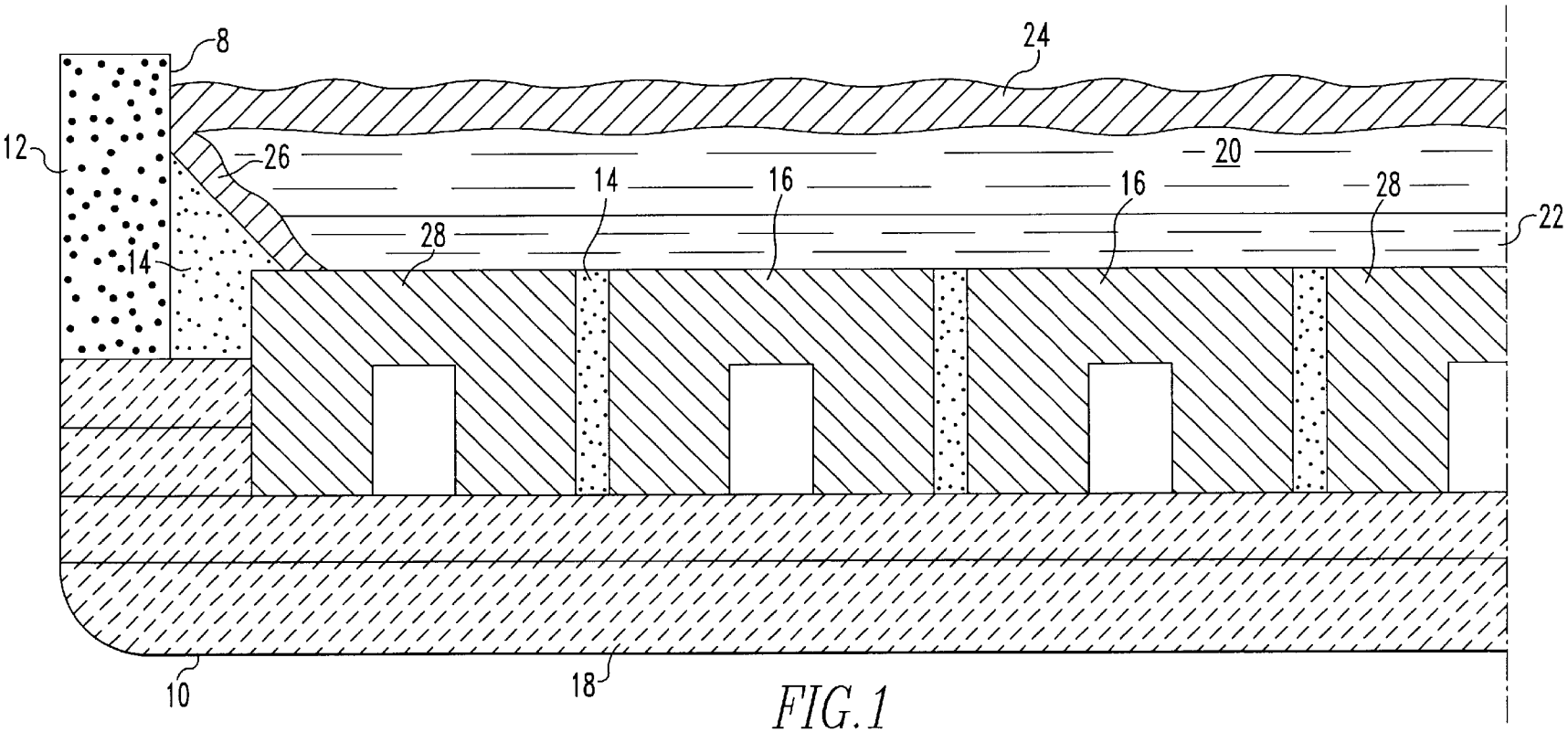
FIG. 1 is a cross-sectional view of a section of a wall and bottom of a Hall cell used for making aluminum.

FIG. 1 shows a typical construction of a cell bottom 10 with sidewall lining 12, part of which is exposed to air above frozen layer 24. Also shown are rammed joints 14. Prefabricated cathode blocks 16 are placed on top of insulating refractories 18. Blocks 16 are traditionally made from rotary kiln or gas calcined anthracite aggregate or electrically calcined anthracite, mixed with a pitch binder. Graphite components can be substituted to increase electrical conductivity. In prefabrication of cathode blocks, green blocks are shaped and pressed, and subsequently baked in special furnaces. Ramming paste 14 is used to fill the spaces and form seams between individual cathode blocks, also to connect the side walls with the carbon blocks. Hot ramming pastes consist of an anthracite filler and a pitch binder. Room temperature paste binder formulations are usually based on a coal-tar or a coal-tar pitch, with a solvent or other additive to lower its softening point and/or increase its coke yield. Also, molasses or additions of solid pitch fines may be included in some formulations. The ramming paste is baked in situ on cell start-up. Ramming paste may be used for the carbonaceous cathodes to form the so-called monolithic cathodes. The sidewalls are usually made from prebaked carbon blocks, ramming paste, or a combination of both or sometimes a non-carbonaceous material such as silicon carbide because it minimizes air oxidation. The desired properties of the sidewall are, however, different from those sought for the cathode bottom. Carbonaceous sidewalls have the problem of air burning when exposed and are not always the preferred choice.

The cell is shown filled with molten cryolite electrolyte 20. A layer of molten aluminum 22 is shown between electrolyte 20 and cathodes 16. A layer 24 of frozen cryolite is provided covering molten cryolite 20. In addition, frozen cryolite 26 is shown as a layer around the perimeter of the cell above surface 28 of cathodes 16. Anodes are not shown in FIG. 1 but normally project through crust or layer 24 into close proximity to surface 28 of cathodes 16.

As noted earlier, the molten aluminum has the problem that it does not readily wet surface 28 of cathodes 16 and reacts with carbon in the cathode to form aluminum carbide. The carbide then dissolves into electrolyte which, with excess alumina, forms a sludge which collects between carbon cathode and metal. The cathode can be consumed at a rate exceeding 2 cm per year for an operating cell. The present invention is designed to improve the wettability of the cathode surface with molten aluminum and inert or minimize reaction of the carbon in the cathode with molten aluminum.

In accordance with the invention, carbon cathode blocks or carbon potlining blocks are subject to a treatment to fill pores in the carbon blocks with a melt comprised of a material reactive with a source of titanium or zirconium or like metal, for example, boron oxide, sodium borate, and lithium borate, to form titanium or zirconium diboride or other such boride which improves wettability of the cathode blocks with molten aluminum. The reactive material must be capable of reacting with titanium or other metal under conditions prevailing in the carbonaceous material present in the cathode block utilized in aluminum-producing electrolytic cell during operation or heat-up for operation.

The carbon blocks such as cathode blocks or potlining blocks are prepared for use in the cell by treating the blocks with a melt which intrudes or impregnates the pores in the carbon blocks. For example, a boron oxide melt is prepared and the carbon blocks immersed in the melt. Thereafter, the melt is subject to pressure to force melt into pores of the carbon bodies or blocks. The carbon block is withdrawn from the melt and excess melt removed. The carbon blocks are then ready for use in the electrolytic cells and ramming pastes or seam mix may be used in the traditional manner.

By carbon as used herein is meant to include carbon as used in potlinings and cathode blocks, as used in aluminum-producing electrolytic cells.

Figure 2:
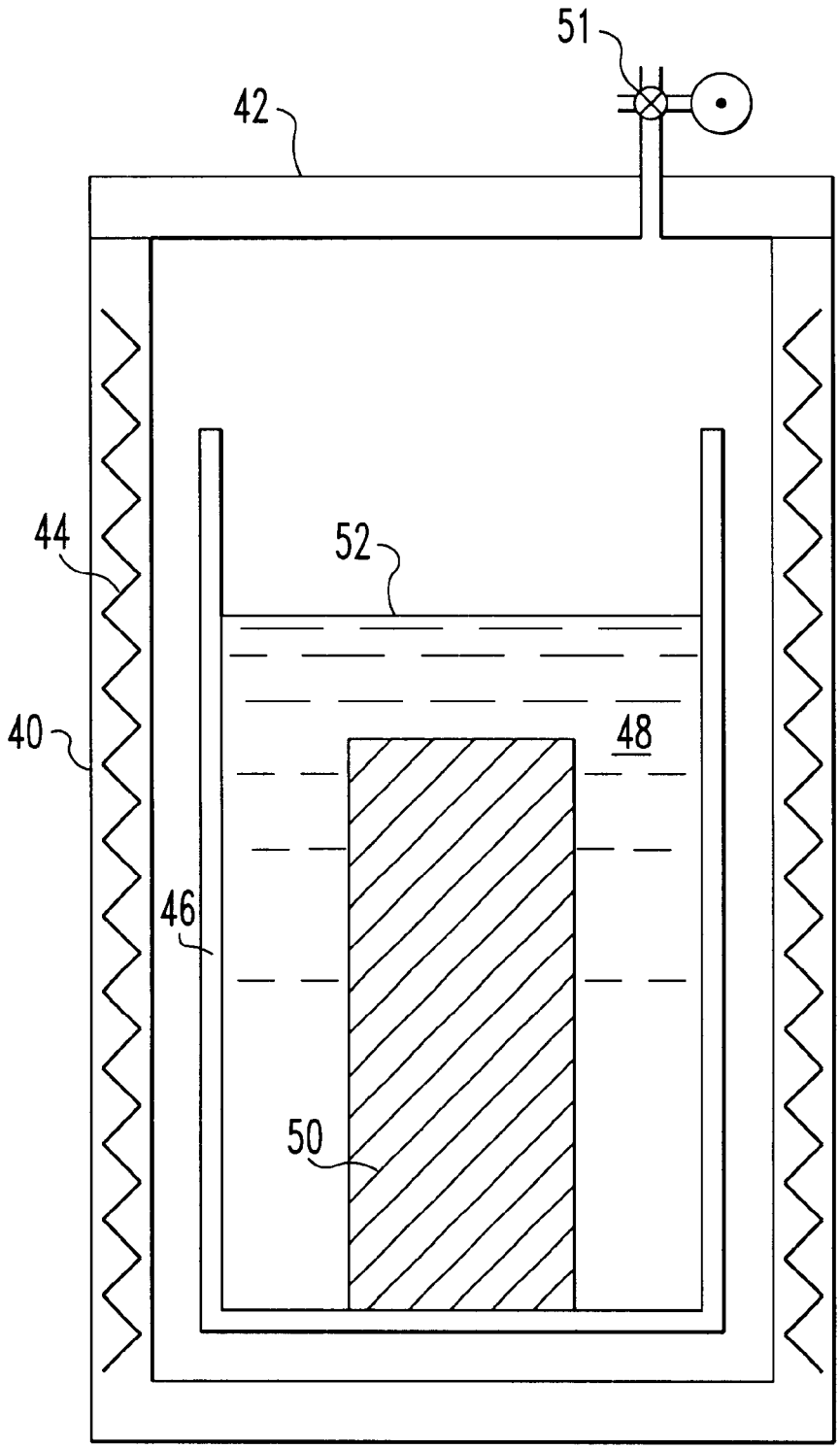
FIG. 2 is a cross-sectional view illustrating a chamber for intruding melt into the pores of the carbonaceous material.

A vessel suitable for impregnating the carbon blocks is illustrated in FIG. 2 where 40 indicates a heated pressure vessel having a lid 42 which seals against the vessel. Vessel 40 is heated by heaters 44. A crucible 46 is provided inside vessel 40 to contain melt 48 used to penetrate pores in the carbon. A carbon block 50 is shown immersed under surface 52 of melt 48. It will be appreciated that means (not shown) can be supplied to suspend and remove block 50 from vessel 40. Also, means is provided for supplying gas, such as argon or nitrogen gas, to vessel 40. The gas, supplied through valve 52, is held at the require pressure, as noted herein.

A melt which has been found useful in the present invention is comprised of boron oxide. The boron oxide is preferably heated to a temperature in the range of 500° to 1200° C. with a typical temperature being in the range of 780° to 800° C. Typical pressures that may be used can range from 10 to 10,000 psi with pressures such as 100 to about 250 psi having been found to be satisfactory.

In a preferred embodiment of the invention, an additive consisting of compounds of sodium, potassium, lithium or other alkali, alkaline earth or rare earth metals may be added to the melt for purposes of reducing the viscosity of the melt. Preferred materials added to the melt include sodium tetraborate or borax, potassium tetraborate, lithium tetraborates or calcium tetraborate. Other compounds that may be used include phosphates, sulfates, fluorides, fluoro borates, carbonates, and carbides. Further, derivatives of boron oxide such as boric acid, sodium borate, or as noted, sodium tetraborate may be used as major melt compounds. The boron compounds are preferred because they can combine with titanium or zirconium to form the boride thereof.

Compounds of sodium and like materials can be added to the melt in an amount effective in reducing the melt viscosity thereby improving penetration of the pores. Materials added for reducing viscosity may be added in an amount in the range of about 1 to 10 wt. %, with a preferred amount being about 2 to 3 wt. %.

Titanium dioxide, titanium fluoride, sodium titanate, or like material, as noted herein, e.g., zirconium, vanadium, hafnium, niobium, chromium, and molybdenum compounds, may be added to the melt. Such materials when added to the melt also can have the effect of reducing viscosity of the melt and can facilitate impregnation of the melt into the pores of the carbonaceous block. Titanium or zirconium compounds have the additional benefit that they can provide at least partial reaction with boron oxide in the melt. Thus, this can provide for improved wetting of the cathode with molten aluminum. Any source of titanium may be added to the melt which reacts with boron oxide to form the metal boride which facilitates wetting of the cathode. Typically, the titanium source can be added up to about 10 wt. %, for example, 1 to 10 wt. %, and preferably in the range of 2 to 4 wt. %.

In the subject invention, titanium diboride, for example, forms in accordance with the equation:

$$5Ti+2B_2O_3 \rightarrow 2TiB_2+3TiO_2.$$

The titanium diboride reaction is enhanced in the presence of sodium, as follows:

$$3Na+2Ti+2B_2O_3 \rightarrow 2TiB_2+3NaBO_2.$$

If titanium dioxide is present in the boron oxide melt, it is believed that the presence of sodium can cause titanium diboride to form as follows:

$$10Na+6B_2O_3+TiO_2 \rightarrow TiB_2+10NaBO_2.$$

Of the above compounds reactive with titanium or zirconium, the preferred compounds are boron oxide and its derivatives such as boric acid, sodium borate and sodium tetraborate. That is, the boron oxide compounds are preferred because they can combine with titanium to form titanium diboride. Of the boron oxide compounds, boron oxide ($B_2O_3$) is preferred.

When the source of titanium is the pot metal or aluminum in the cell, titanium is present in the aluminum in an amount in the range of 0.01 to 0.5 wt. %, preferably 0.015 to 0.05 wt. %.

It should be noted that all ranges set forth herein include all numbers within the range as if specifically set forth.

The melt or reactive material in the pores should be capable of reacting with titanium or zirconium to form titanium diboride or zirconium diboride at operating conditions prevalent in the carbonaceous material in the electrolyte cell during operation. Thus, the reactive material, e.g., boron oxide, should be capable of reacting with titanium or zirconium in the presence of carbon and aluminum or sodium in a temperature range of 500° to 1000° C.

In the process of using the present invention, a carbonaceous material comprising carbon is fabricated from a green mix into a suitable liner block or cathode block for use in an aluminum-producing electrolytic cell. The green mix is then shaped into cathode blocks or liner blocks. The green cathode blocks or liner blocks are then baked before use, whereby volatile material is driven off. Baking is practiced to various extents, resulting in amorphous or graphitized blocks. The baked blocks are then submerged in a suitable melt and usually permitted to remain therein for a period that permits air and moisture to escape from the pores. Thereafter, pressure is applied to the melt to force it into pores of the carbonaceous blocks. After impregnation, the blocks are withdrawn and excess melt removed. Then, during operation of the cell, the reactive compound intruded into the pores of the carbonaceous block will operate in its reducing environment to react with a source of titanium or zirconium to form titanium diboride or zirconium diboride at the surface of the carbonaceous block contacted by the molten aluminum. The titanium diboride or zirconium diboride are wet by the molten aluminum and are essentially inert. Further, the titanium diboride or zirconium diboride are highly electrically conductive. Thus, the cell operates with greater efficiency and the cathode surface contacted by the molten aluminum has decreased wear or consumption forming aluminum carbide with molten aluminum. That is, the rate of this reaction is minimized and consumption of the cathode is minimized.

As the surface wears due to dissolution of titanium diboride into the metal, the titanium diboride coating is continuously regenerated.

The titanium or zirconium can be made available for reaction in different ways. For example, titanium metal powder or a titanium compound can be mixed in boron oxide melt and applied simultaneously. The titanium can be plasma sprayed onto the cathode surface containing the reactive compound, e.g., boron compound. In another method, titanium metal can be provided in the molten metal to react with the boron compound in the cathode surface layer to form titanium diboride. Or, a titanium compound can be dissolved in the electrolyte and reacted out of the electrolyte at the start-up of the cell and during cell operation. Further, a titanium compound, e.g., $TiO_2$, can be provided in the carbon comprising the anode to supply titanium as the anode is consumed. It will be appreciated that a source of titanium can be supplied periodically over the life of the cell to rejuvenate the titanium diboride. Thus, this approach has the advantage of in-situ repairing of defects in the titanium diboride lining layer without shutting down the cell.

The treated carbonaceous block can provide for improved wettability of the carbon cathode and at the same time can act to suppress formation or accumulation of cyanide compounds.

Cyanide compounds form in the carbonaceous lining of electrolytic cells during the production of aluminum. Cyanide compounds form in the carbonaceous material from the presence of carbon, sodium and nitrogen at elevated temperatures. The carbon source is the carbonaceous cell lining, i.e., carbonaceous blocks, carbonaceous boards, and carbonaceous based ramming mix and seam paste used. Sodium results from the molten salt electrolyte containing cryolite ($Na_3AlF_6$) used to dissolve alumina ($Al_2O_3$). In the electrolytic reduction of alumina to aluminum and carbon dioxide, some sodium of the electrolyte is reduced at the same time as the alumina. The sodium that is reduced from electrolyte provides free sodium. The sodium migrates or is transferred through or into the carbonaceous lining and ramming paste. The source of nitrogen for the reaction is provided by the air which penetrates into the cathode blocks and into the carbonaceous liner. The reaction that produces undesirable sodium cyanide is as follows:

$$2C+2Na+N_2 \rightarrow 2NaCN.$$

Thus, it is important to suppress or stop the formation or accumulation of cyanide compounds such as sodium cyanide in potlinings of aluminum-producing electrolytic cells. Potlinings and cathode blocks treated in accordance with melt of the invention are resistant to formation of cyanide compounds. That is, materials constituting the melt are capable of reacting with sodium, nitrogen or sodium cyanide under the conditions prevailing in the carbonaceous material present in the liner and cathode block utilized in an aluminum-producing electrolyte cell. Thus, the treatment of the lining and blocks can react with sodium, nitrogen or sodium cyanide in the presence of carbon to avoid or suppress the formation or accumulation of cyanide compounds.

The melt can comprise carbide, fluoride, oxyfluoride, sulfate, carbonate, phosphate, or oxide, which is reactive with sodium, nitrogen or sodium cyanide in the presence of carbon to avoid the formation or accumulation of cyanide compounds. A metal reactive with sodium, nitrogen or sodium cyanide such as aluminum, magnesium, silicon, boron or zinc, may be used. The metals may be provided in finely divided or powder form in the melt. Examples of reactive carbide compounds useful in the invention include silicon carbide, aluminum carbide, titanium carbide and boron carbide. Reactive fluoride compounds useful in the melt of the invention include aluminum fluoride ($AlF_3$), cryolite ($Na_3AlF_6$), titanium fluoride ($TiF_3$), zirconium fluoride ($ZrF_4$), calcium fluoride ($CaF_2$) and magnesium fluoride ($MgF_2$). Examples of reactive carbonate compounds useful in the melt of the invention are lithium carbonate ($Li_2CO_3$), calcium carbonate ($CaCO_3$) and barium carbonate ($BaCO_3$). An example of a reactive phosphate compound is boron phosphate ($BPO_4$). Examples of reactive oxide compounds include boron oxide, sodium borate, calcium borate, sodium tetraborate, boric acid, calcium oxide and rare earth oxides.

Of the above compounds reactive with sodium, nitrogen or sodium cyanide, the preferred reactive compounds are boron oxide and its derivatives such as boric acid, sodium borate and sodium tetraborate. That is, the boron oxide compounds are preferred because they can combine with sodium or nitrogen. Further, the boron oxide compounds are preferred because they are reactive with cyanide compounds such as sodium cyanide to convert or decompose it to environmentally benign compounds such as boron nitride and sodium borates. That is, if for some reason, sodium cyanide forms, reactive boron oxide compounds are effective in reacting and converting the cyanide compound to environmentally benign compounds. Of the boron oxide compounds, boron oxide ($B_2O_3$) is preferred. Also, preferably, the novel melt material comprises boron oxide and a source of sodium such as sodium tetraborate. However, any of the above noted compounds may be provided in the melt or combinations of such compounds may be used.

The reactive compound comprising the melt should be capable of reacting with sodium, nitrogen or sodium cyanide at operating conditions prevalent in the carbonaceous material in the electrolyte cell during operation. Thus, the reactive compound comprising the melt should be capable of reacting with sodium, nitrogen or sodium cyanide in the presence of carbon in a temperature range of 500 to 1000° C.

When the reactive compound comprising the melt is boron oxide, for example, it has the capability of reacting with the sodium cyanide to form boron nitride and sodium borates according to the following reaction:

$$6NaCN+7B_2O_3 \rightarrow 6C+2N_2+2BN+3Na_2B_4O_7.$$

Thus, it will be appreciated that the electrolytic cell can be operated for a number of years and then treated as noted to decompose sodium cyanide formed in the liner, or cathode block to capture free sodium or nitrogen therein.

In another aspect of the invention, it has been discovered that impregnation of the carbonaceous blocks used for the potlining with melt such as boron oxide greatly reduces oxidation or air burning of the exposed portion of the potlining. That is, in reference to FIG. 1, there is shown portion 8 of potlining 12 which extends above layer 24 of frozen cryolite. When potlining 12 is fabricated of carbonaceous material, portion 8 is subject to air burning or severe oxidation seriously affecting the effective life of the potlining. It has been discovered that impregnation of carbonaceous material used for potlining 12 with melt as disclosed herein greatly reduces or substantially eliminates air burning of the carbon and thus increases its useful life. Also, impregnation of cathode blocks with melt, suppresses air-burning during cell start-up.

The following examples are further illustrative of impregnating carbon blocks with a melt comprising boron oxide.

In the following three examples, specimens of various carbonaceous potlining materials were drilled and tapped for threading onto a ¼ inch diameter steel rod used for lowering and raising the specimen into and out of a pressure vessel containing the melt. All of the specimens were first dried at 140° C. for 12 hours to remove moisture and then weighed to obtain a dry weight to later determine the amount of impregnation. Then, the specimen was threaded onto the steel rod and placed in a boron oxide melt maintained in the pressure vessel at a temperature of about 780° to 800° C. The specimens were kept in the melt for about 60 minutes to permit air and remaining moisture to escape from the pores. The pressure vessel was then sealed and brought to a pressure of 160 psi using argon gas and kept at this pressure for 1 hour for the purpose of impregnation melt in pores of the carbon block. At the end of the impregnation period, the pressure was released, the specimen withdrawn, and excess melt removed. The specimens were weighed to determine weight gain.

EXAMPLE 1

In this example, the specimen used was commercial graphitized block material, circular in cross section, having a diameter of 2 inches and length of approximately 4 inches. The melt composition used was made up of 2000 g $B_2O_3$ (4 mesh) and 60 g of anhydrous $Na_2B_4O_7$ (quality 99.5%). The initial weight of the specimen was 336.25 g, the weight after impregnation and cleaning 392.13 g; the weight gain was 55.88 g or 16.6% by wt.

EXAMPLE 2

In this example, a specimen of commercial graphitized block material having a rectangular shape was used. The specimen was 6 inches long, 3 inches wide, and 2 inches thick. The melt composition was made up of 2000 g $B_2O_3$ (4 mesh) and 60 g of anhydrous $Na_2B_4O_7$ (quality 99.5%). The initial weight of the specimen was 931.64 g and the weight after impregnation and cleaning was 1084.07 g. The weight gain was 152.36 g or 16.4 wt. %.

EXAMPLE 3

This specimen was comprised of the same material and shape as that used in Example 2 except measured 4 inches in length. The melt composition was made up of 2000 g $B_2O_3$ (4 mesh) and 60 g of anhydrous $Na_2B_4O_7$ (quality 99.5%) and 40 g of $TiO_2$. The initial weight of the specimen was 611.01 g, the weight after impregnation and cleaning 722.54 g; the weight gain, accordingly, was 111.53 g or 18.3% by wt.

EXAMPLE 4

In this fourth example, two carbon blocks, approximately 1.5 inches long, 2 inches wide, and 3 inches thick, one impregnated with boron oxide, were heated to 900° C. and remained at temperature for 5 hours. The impregnated block contained 15% boron oxide. After 5 hours at 900° C., the non-impregnated carbon block lost 12% of its weight to oxidation or air burning. The boron oxide impregnated block lost 5% of its weight; however, most of the 5% weight loss was due to boron oxide which tended to ooze from the pores, and very little of the weight loss was caused by air burning of the carbon. Thus, the use of boron oxide greatly extends the useful life of exposed carbon to air burning in an electrolytic cell.

These examples demonstrate that a melt can be prepared and impregnated into the pores of carbon blocks. Further, it will be seen that materials such as titanium dioxide can be incorporated in the melt of boron oxide and impregnated therewith into the pores of the carbon block where they can react to form titanium diboride for improved wettability of the block with molten aluminum.

While the invention has been described in terms of preferred embodiments, the claims appended hereto are intended to encompass other embodiments which fall within the spirit of the invention.

What is claimed is:

1. A method of preparing carbonaceous blocks for use as a cathode in an electrolytic cell for producing aluminum wherein the cell contains an electrolyte and has molten aluminum contacting the cathode, the cathode having improved wettability with molten aluminum, the method comprising the steps of:

(a) providing a carbonaceous block;

(b) providing a boron oxide containing melt;

(c) immersing said carbonaceous block in said melt having added thereto an additive to facilitate impregnating said melt into pores in said block;

(d) applying pressure to said melt to impregnate said melt into said pores in said carbonaceous block; and (e) withdrawing said carbonaceous block from said melt, the carbonaceous block having boron oxide containing melt intruded in pores in said block, the boron oxide capable of reacting with a source of titanium or zirconium to form titanium in or zirconium diboride during heatup or operation of said cell.

2. The method in accordance with claim 1 including adding titanium or zirconium dioxide to said melt for impregnation of said pores with boron oxide to form titanium or zirconium diboride.

3. The method in accordance with claim 2 including maintaining said titanium or zirconium compound in said melt in a range of 0.1 to 10 wt. % on a titanium or zirconium basis.

4. The method in accordance with claim 1 including adding a borate of sodium, potassium, lithium, calcium, magnesium, and titanium to said melt to facilitate impregnating melt into said pores.

5. The method in accordance with claim 4 including adding a source of sodium to the melt.

6. The method in accordance with claim 5 wherein said source of sodium is sodium tetraborate.

7. The method in accordance with claim 1 wherein said melt comprises 1 to 10 wt. % sodium tetraborate.

8. The method in accordance with claim 1 wherein said melt comprises 2 to 3 wt. % sodium tetraborate.

9. The method in accordance with claim 1 wherein the source of titanium is titanium metal provided in the aluminum metal or a titanium compound provided in electrolyte in said cell or in anodes used in the cell.

10. The method in accordance with claim 1 including providing the source of titanium in a range of 0.015 to 0.05 wt. % titanium in the molten aluminum in the cell.

11. The method in accordance with claim 1 including maintaining said melt at a temperature in the range of 500° to 1200° C.

12. The method in accordance with claim 1 including applying pressure to said melt in a range of 10 to 10,000 psi.

13. The method in accordance with claim 1 wherein said carbonaceous block is graphitized carbon.

14. The method in accordance with claim 1 wherein said carbonaceous block is comprised of amorphous carbon.

15. A method of preparing carbonaceous blocks for use as an improved cathode in an electrolytic cell for producing aluminum from alumina dispersed in an electrolyte wherein the cell contains molten aluminum in contact with the cathode, the cathode having improved wettability with molten aluminum, the method comprising;

(a) providing a carbonaceous block;

(b) providing a melt of boron oxide having an additive to facilitate impregnation of said melt into pores in said block, said additive selected from a compound of the group consisting of sodium borate, potassium borate, lithium borate, magnesium borate, and calcium borate;

(c) immersing said carbonaceous block in said melt;

(d) applying pressure to said melt to impregnate said melt into pores in said carbonaceous block; and (e) withdrawing said carbonaceous block from said melt, the carbonaceous block having melt intruded in said pores, the boron oxide capable of reacting said compound to form a boride to provide improved wettability of said cathode with molten aluminum.

16. A method of treating carbonaceous blocks for use as liner material in an aluminum producing cell using an electrolyte comprised of sodium containing salts, the block being resistant to formations or accumulations of sodium cyanide and exposed portion, said liner material resistant to air burning during operation of the cell, the method comprising:

(a) providing a carbonaceous block for use as a liner material;

(b) providing a boron oxide containing melt having added thereto an additive to facilitate impregnating said melt into pores in said block;

(c) immersing said carbonaceous block in said melt;

(d) applying pressure to said melt to impregnate pores in said carbonaceous block with said melt; and (e) withdrawing said carbonaceous block from said melt to provide a treated block having boron oxide containing melt in said pores.

17. The method in accordance with claim 16 including adding a borate of sodium, potassium, lithium, calcium, titanium, magnesium, and zirconium to said melt to facilitate impregnating melting into said pores.

18. The method in accordance with claim 16 including adding a source of sodium to the melt.

19. The method in accordance with claim 18 wherein said source of sodium is sodium tetraborate.

20. The method in accordance with claim 16 wherein said melt comprises 0.5 to 10 wt. % sodium tetraborate.

21. The method in accordance with claim 16 wherein said melt comprises 2 to 3 wt. % sodium tetraborate.

22. A method of producing aluminum in an electrolytic cell containing alumina dissolved in an electrolyte contained in the cell, the method comprising the steps of:

(a) providing an electrolytic cell;

(b) providing a carbonaceous cathode in said cell, the carbonaceous cathode comprised of bodies of carbonaceous material, said bodies treated in a boron oxide containing melt by impregnating boron oxide containing melt into pores in the carbonaceous bodies by applying pressure to the melt said melt containing an additive to facilitate impregnating melt into said pores; and (c) passing an electric current through said cell to produce aluminum at said cathode simultaneously therewith reacting boron oxide in said pores with a source of titanium to form titanium diboride to provide improved wetting of said cathode surface with molten aluminum.

23. The method in accordance with claim 22 including adding a titanium or zirconium compound to said melt for impregnation into said pores with boron oxide to form said titanium boride.

24. The method in accordance with claim 23 including maintaining titanium or zirconium dioxide in said melt in a range of 0.5 to 10 wt. % on a titanium or zirconium weight basis.

25. The method in accordance with claim 23 including adding a borate of sodium, potassium, lithium, calcium, magnesium, and titanium, to said melt to facilitate impregnating melt into said pores.

26. The method n accordance with claim 22 including adding a source of sodium to the melt.

27. The method in accordance with claim 26 wherein said source of sodium is sodium tetraborate.

28. The method in accordance with claim 22 wherein said melt comprises 0.5 to 10 wt. % sodium tetraborate.

29. The method in accordance with claim 22 wherein said melt comprises 2 to 3 wt. % sodium tetraborate.

30. The method in accordance with claim 22 wherein the source of titanium is titanium metal provided in the aluminum metal or a titanium compound provided in the electrolyte in the cell.

31. The method in accordance with claim 22 including providing 0.015 to 0.05 wt. % titanium in the molten aluminum in the cell.

32. The method in accordance with claim 22 including maintaining said melt at a temperature in the range of 500° to 1200° C.

33. The method in accordance with claim 22 including applying pressure to said melt in a range of 10 to 10,000 psi.

34. The method in accordance with claim 22 wherein said carbonaceous cathode is graphitized carbon.

35. The method accordance with claim 22 wherein said pressure is applied for a period of 1 to 24 hours.

* * * * *